United States Patent [19]

Flaherty

[11] 4,119,196

[45] Oct. 10, 1978

[54] COLLAPSIBLE PACKAGE

[75] Inventor: Kenneth A. Flaherty, Louisville, Ky.

[73] Assignee: Brown & Williamson Tobacco Corporation, Louisville, Ky.

[21] Appl. No.: 792,739

[22] Filed: May 2, 1977

[51] Int. Cl.[2] ..... B65D 85/10

[52] U.S. Cl. ..... 206/271; 206/273; 229/41 B

[58] Field of Search ..... 206/271, 273, 265; 229/41 B, 41 R, DIG. 3

[56] References Cited

U.S. PATENT DOCUMENTS

| | | | |
|---|---|---|---|
| 1,956,325 | 4/1934 | Hart | 229/DIG. 3 |
| 2,680,557 | 6/1954 | Madden | 229/41 B |
| 2,772,810 | 12/1956 | Arneson | 206/171 |
| 2,988,261 | 6/1961 | Keating | 229/41 B |
| 3,058,581 | 10/1962 | Keating | 206/273 |
| 3,269,637 | 8/1966 | Whittaker | 229/41 B |

*Primary Examiner*—William T. Dixson, Jr.

*Attorney, Agent, or Firm*—William J. Mason; Charles G. Lamb

[57] ABSTRACT

A partially collapsible package including a pair of opposing rigid front and rear panels. A bottom panel and a pair of side panels are hinged to the front and rear panels to form a package closed at the bottom and open at the top to receive and remove articles therethrough. Each side panel and the bottom panel has a weakened zone to permit collapse of the package in the direction bringing the front and rear panels together. An arrangement of tabs is hinged to the house and positioned so that as the package is collapsed the tabs will be free for limited movement to permit partial collapse of the package and then to support the package and resist further collapse by engagement between the moved tabs and surfaces of the package thereby providing for a partially collapsed supporting package to protect articles contained therein when the package is full and while articles are being removed and the package collapsed accordingly.

25 Claims, 10 Drawing Figures

COLLAPSIBLE PACKAGE

BACKGROUND OF THE INVENTION

In the packaging of smoking articles, particularly cigarettes, there are a variety of different types of packs. The traditional soft pack is of conventional flexible paper consistency and merely provides a wrapper and holder for the cigarettes without affording any damage protection for the product. The other common type of pack is known as a hard pack and it is formed of a rigid material, often paperboard, which retains its generally rectangular configuration independent of the presence of cigarettes within.

Both types of packages have their advantages and disadvantages. For example, the soft pack is advantageous in that it offers minimum resistance to collapse or flattening as cigarettes are removed. In fact, when empty the pack is crumbled and discarded. Without any resistance to deformation, the soft pack produces no discomfort when in one's pocket. On the other hand, the soft pack offers not protection to the cigarettes contained therein and application of a minimum amount of force can cause damage to the cigarettes sufficient to render them unusable which can happen quite easily, for example, when the soft pack is contained in a person's pocket.

Conversely, the hard pack offers protection for the cigarettes since it is sufficiently rigid so that the pack can withstand substantial force before deforming and permitting damage to the cigarettes. This is true whether the pack is partially or entirely full of cigarettes. Naturally, due to the rigidity of the package, the corners and edges of the rectangularly shaped hard pack can cause discomfort particularly when the hard pack is contained in one's pocket or other article of clothing.

Early examples of collapsible boxes for smoking articles are contained in U.S. Pat. Nos. 405,413 and 1,122,513 which disclose small cigar boxes. Additionally, various types of collapsible cigarette boxes have been developed over the years. Examples are disclosed in U.S. Pat. Nos. 2,904,169; 2,988,261, 3,058,581; 3,125,213; and 3,272,320.

It would certainly be an improvement in the cigarette packaging field and the smoking article field in general to provide a cigarette pack which has advantages present in both the hard and soft pack discussed above and which alleviates the undesirable traits of both types of package. Naturally, an improved package which produces this result would have to be one which is inexpensive and can be easily and efficiently assembled thereby maintaining the manufacturing costs at the same relative level as presently exist with the soft and hard packs.

Naturally, the type of package under consideration is also useful in many instances with a variety of other types of products in addition to smoking articles. Examples of teachings relating to collapsible box-like structures for foods and other articles are disclosed in U.S. Pat. Nos. 2,680,557; 3,630,430; 2,984,401; and 3,083,890.

SUMMARY OF THE INVENTION

With the above background in mind, it is among the primary objectives of the present invention to provide a package that partially collapses with usage, but largely retains its shape. It is adapted for use with many types of products, including smoking articles such as cigarettes. It is an objective to provide a package of rigid material which is designed so that it will collapse or flatten upon use to a certain extent to avoid potential contact of corners and edges against various parts of the body of the consumer, while retarding or restricting the amount of collapse by providing secondary support after the package has been collapsed a predetermined amount so that the package is not collapsed to too great an extent whereby the cigarettes or other articles contained therein are damaged or destroyed.

It is an objective of the present invention to provide a cigarette package wherein as cigarettes are withdrawn from the pack, it will tend to flatten out a proportionate amount when subjected to a minimum amount of force whereby facilitating the placement of the pack in pockets, under belts, in socks or boots and various other places where consumers tend to carry packages of this type. The hard surfaces are retained to protect the cigarettes contained within the pack, even when it is partially collapsed.

A further objective is to provide surfaces which are movable as part of the package, so that they engage with other surfaces of the pack for support when the package has been collapsed a predetermined amount so that the corner and edge problem is avoided and the cross section of the package is decreased in depth in accordance with the amount of cigarettes removed therefrom. Another objective is to provide movable tabs as part of the package which will shift upon collapse into engagement with opposing walls of the package to restrict collapse beyond a predetermined amount, for example about 60 percent of the original depth.

It is a still further objective to provide the package, including tabs, as a unitary package blank of rigid material which is creased at appropriate points to facilitate bending of relative parts thereof to form a package having a front and back panel and hinged bottom and side panels and movable tabs housed between the panels. Score lines are provided in the side panels and bottom panel to permit partial collapse and movement of the tabs until the tabs engage with inner surfaces in the package and restrict further collapsing of the package in the direction of reduction of depth. The blanks and ultimate package of the present invention are designed so that freedom of collapse is provided to the predetermined degree without deformation or distortion or damage to the package as a protective structure for articles contained therein. The tabs are positioned within the package so that they have freedom of movement without danger of jamming against and/or damaging the inner wrapper and smoking articles contained within the package.

In summary, a partially collapsible package is provided. The package includes a pair of opposing rigid front and rear panels. A bottom panel and a pair of side panels are hinged to the front and rear panels to form a package closed at the bottom and open at the top to receive and remove articles therethrough. Each side panel and the bottom panel have a weakened zone to permit collapse of the package in the direction bringing the front and rear panel together. An arrangement of tabs are hinged to the panels and positioned so that as the package is collapsed the tabs will be free for limited movement to permit partial collapse of the package and then to support the package and resist further collapse by engagement between the moved tab and surfaces of the package thereby providing for a partially collapsible supporting package to protect the articles contained therein when the package is full and while articles are being removed and the package collapses accordingly.

The package is formed of a unitary blank of material which is predesigned to fold into the package described above and then to partially collapse in a uniform manner to the desired degree without damage, distortion or destruction to the package itself or the contents therein.

With the above objectives, among others, in mind, reference is made to the attached drawings.

DESCRIPTION OF THE PREFERRED EMBODIMENTS

Package blank 20 is formed of a conventional cardboard material so that is has the desired rigidity to act as a protective hard pack. It is dimensioned for use as a package for cigarettes. Naturally, the same configuration can be used in connection with other smoking articles as a container and package for the articles. Furthermore, the package is adaptable for use with many other types of products, such as foods, drugs, cosmetics and the like.

Figure 2:
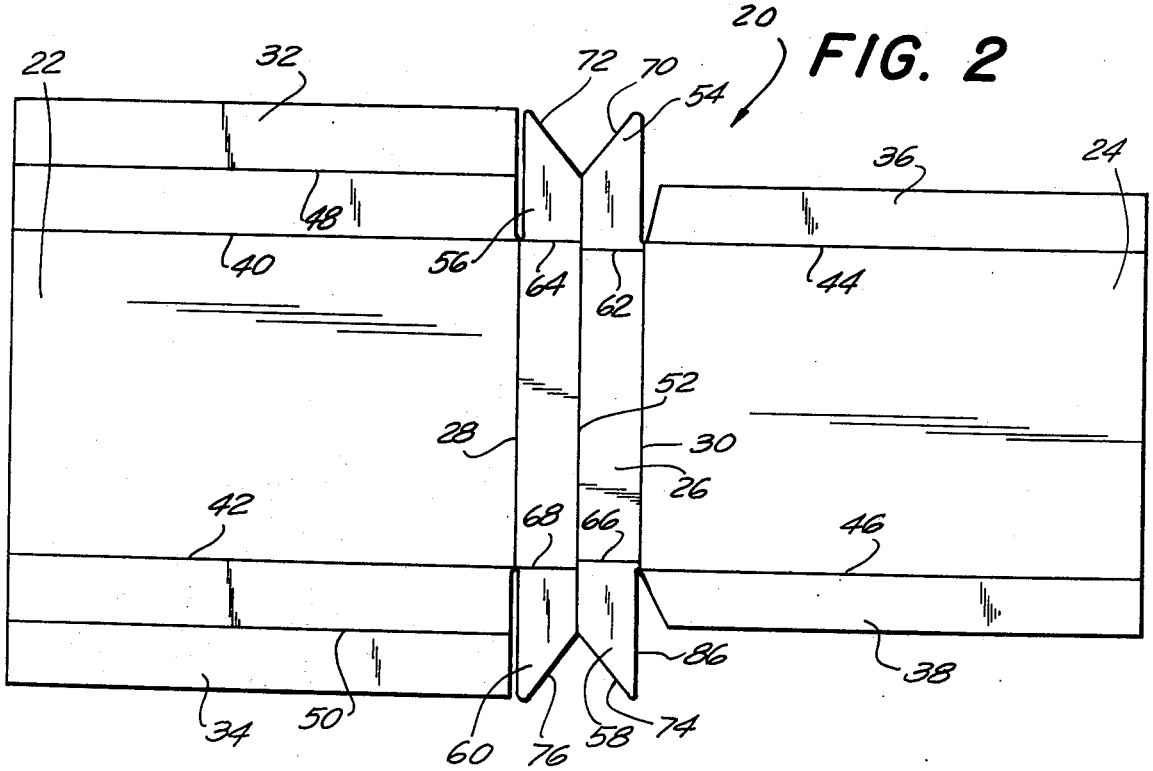
FIG. 2 is a plan view of the package blank utilized in forming the package of the invention.

Blank 20 in its unfolded flat condition as shown in FIG. 2 is formed with a predetermined configuration. The elements of the blank include two large opposing rectangular portions which serve as a front panel 22 and a rear panel 24. These panels are generally of the same size and configuration and determine the width and height of the package. Hinged to panel 22 and 24 is an intermediate portion which forms a bottom panel 26. The hinged connection between bottom panel 26 and front panel 22 is formed by a score line 28. Similarly the hinged connection between bottom panel 26 and back panel 24 is formed by score line 30.

The side panels of the package are formed by lateral projections on front panel 22 and back panel 24 which are interconnected in conventional fashion, such as by adhesive. For this purpose, front panel 22 has a pair of large lateral projections 32 and 34 and back panel 24 has a pair of smaller lateral projections 36 and 38. All of the lateral projections extend from a longitudinal edge on the front or back panels. Larger projection 32 is hinged to front panel 22 by means of score line 40. The other larger projection 34 is also hinged to front panel 22 by a similar score line 42. Smaller projection 36 is hinged to a longitudinal edge of back panel 24 by score line 44 and the remaining projection 38 is hinged to the remaining longitudinal edge of back panel 24 by means of score line 46.

Additionally, each of the larger lateral projections 32 and 34 have an intermediate longitudinal score line 48 and 50, respectively, which assist in facilitating collapse of the package to the desired degree and uniformity upon use. The bottom panel 26 is formed with a centeral score line 52 thereacross for the same purpose. Score lines 48, 50 and 52 are aligned to provide for uniform collapse of the package.

Bottom panel 26 is provided with a pair of laterally extending tabs extending from both sides of the bottom panel. Tabs 54 and 56 extend from one side of bottom panel 26 and corresponding tabs 58 and 60 extend from the opposite side. Each tab is hinged to the bottom panel by an appropriate score line with tab 54 being hinged by score line 62, tab 56 by score line 64, tab 58 by score line 66, and tab 60 by score lines 68. Score lines 62 and 66 are offset with respect to score lines 64 and 68 to facilitate relative overlapping movement of the tabs with respect to one another. Furthermore, each tab is provided with a beveled surface on its free end for arresting collapse of the package at a predetermined point. The beveled surfaces on each adjacent pair of tabs face one another so as to provide a V configuration at the free ends of the tabs. Thus, tab 54 has a bevel surface 70 facing bevel surface 72 of tab 56. In the same manner tab 58 has bevel surface 74 facing bevel surface 76 of tab 60 on the opposite side of bottom panel 26.

Figure 4:
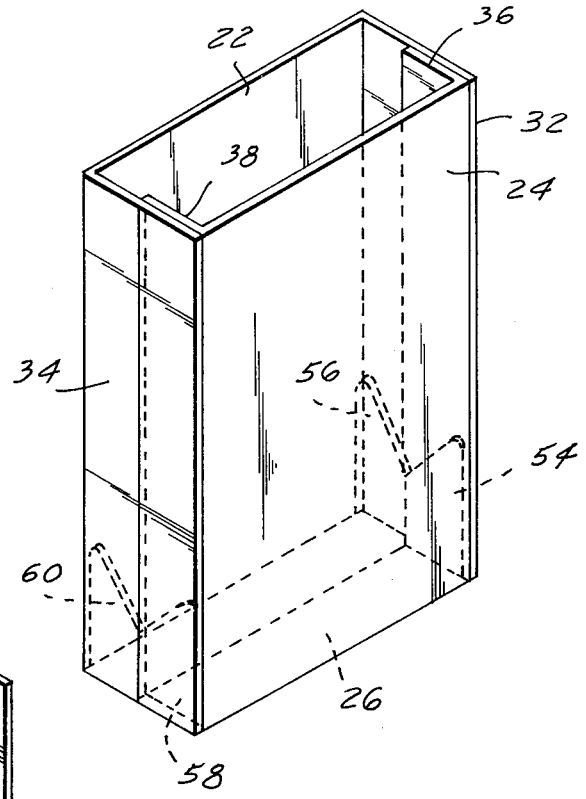
FIG. 4 is a perspective view of the package blank in fully folded condition.
Figure 3:
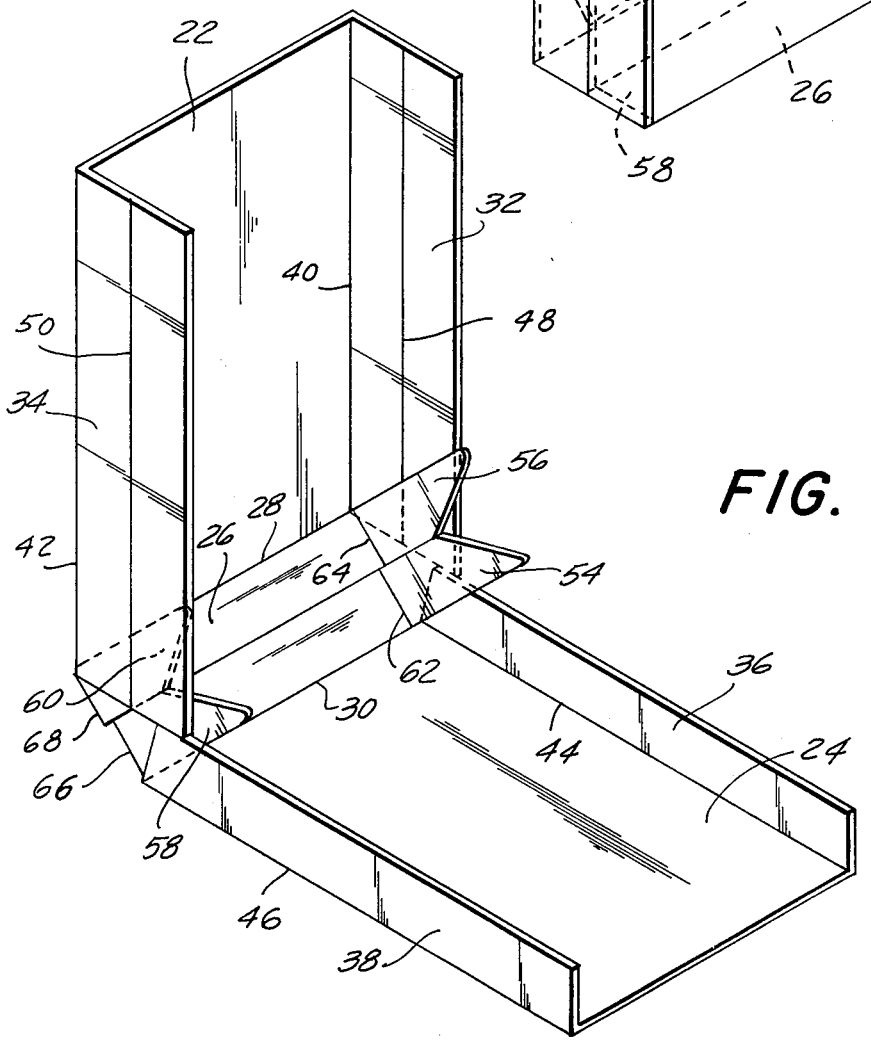
FIG. 3 is a perspective view of the package blank in partially folded condition.

The sequence of forming blank 20 into a package for cigarettes is depicted in FIGS. 3–4. Front panel 22 and back panel 24 are bent 90° into an upright position with respect to bottom panel 26. Panels 22 and 24 are thus brought into vertical alignment. The upward rotation of the panels is permitted by score line 28 with respect to front panel 22 and score line 30 with respect to back panel 24. The tabs 54, 56, 58 and 60 are rotated about score lines 62, 64, 66 and 68 respectively upwardly with respect to the bottom panel approximately 90°. Since the tabs have free ends, they have certain freedom of movement laterally and between the vertical and the horizontal and are offset so that they can shift with respect to one another and slide across one another. Smaller projections 36 and 38 are bent about score lines 44 and 46 approximately 90 degrees with respect to back panel 24. Similarly, larger projections 32 and 34 are bent about score lines 40 and 42, respectively, into an approximate 90° relationship with respect to front panel 22 so that the outer portions of larger projections 32 and 34 are brought into alignment with smaller projections 36 and 38 when the panels 22 and 24 are brought into vertical alignment. Thereafter, suitable adhesive is applied to seal the package into its final configuration.

Folding of the projections into alignment for fastening them together to form two side panels for the package captures the tabs 54, 56, 58 and 60 within the side panels and retains them in substantially vertical configuration. Once the projections have been bonded together, the package blank is formed in its final configuration for use.

Figure 1:
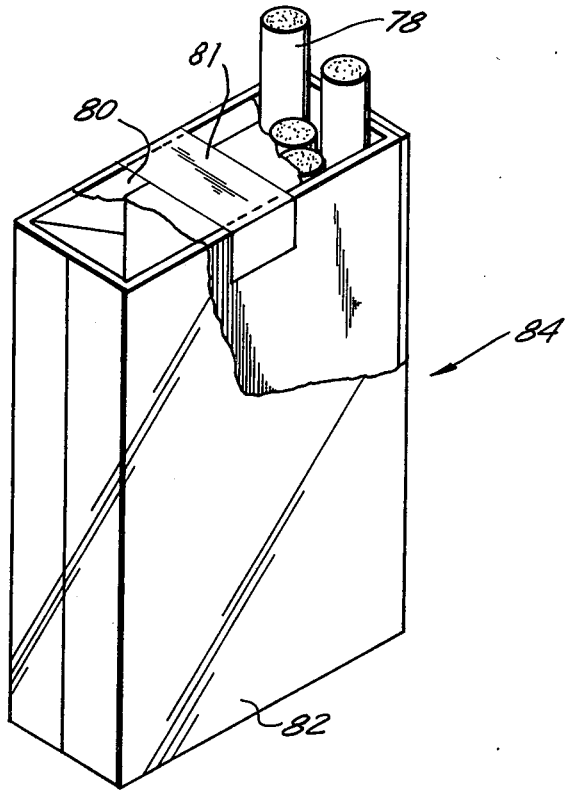
FIG. 1 is a perspective view of the package of the invention open for access to cigarettes contained therein.

In the depicted embodiment, the package is then filled with cigarettes 78 which are conventionally housed within a flexible foil-paper wrapper 80. Thus the tabs extending upwardly within the package are housed between the side panels and the wrapper. A conventional paper closure 81 is bonded to the top of the paper foil wrapper 80 and to the upper end portion of the front and rear panels of the package. An overwrap 82 is then applied to the exterior of the package and the resulting package 84 (FIG. 1) is sealed from shipment and storage and ultimate use. The overwrap and the foil-paper surrounding the cigarettes do not affect the operability of collapsing of the rigid package 84 as cigarettes are removed and used.

Figure 5:
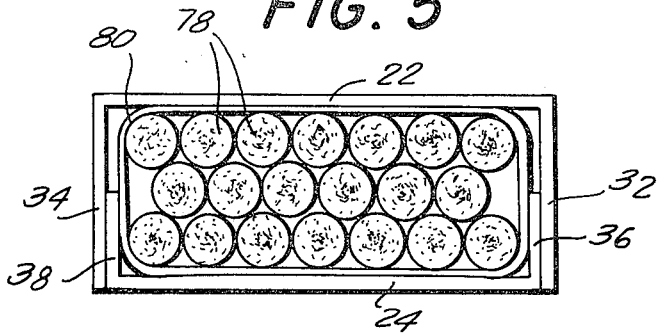
FIG. 5 is a top plan view of the package of the invention containing a full complement of cigarettes.
Figure 6:
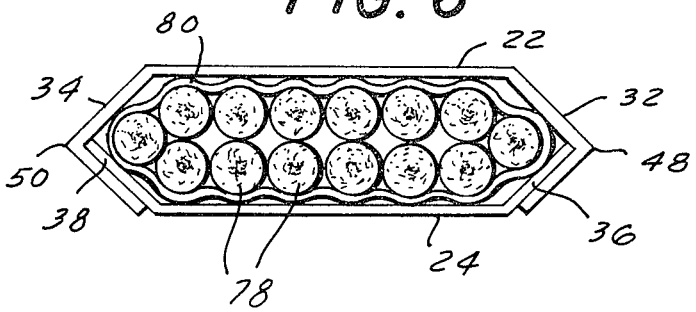
FIG. 6 is a top plan view thereof in partially collapsed condition.
Figure 7:
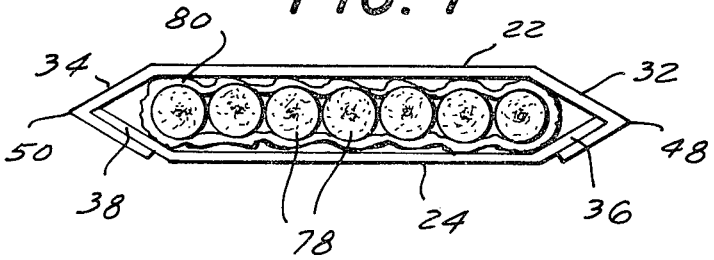
FIG. 7 is a top plan view thereof in a further partially collapsed condition.
Figure 9:
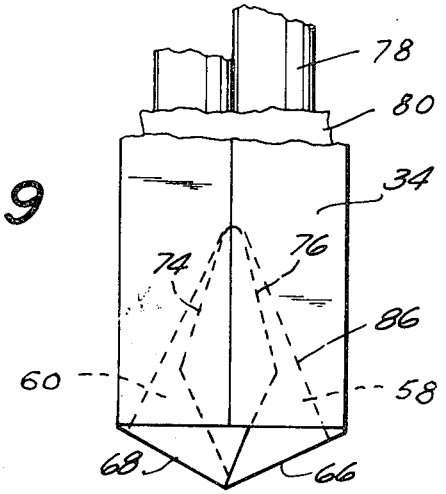
FIG. 9 is a fragmentary side elevation view thereof in partially collapsed condition.
Figure 10:
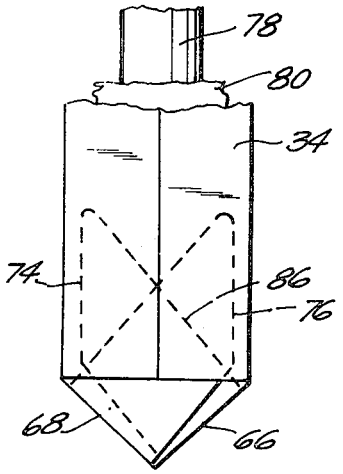
FIG. 10 is a fragmentary side elevation view thereof in a further partially collapsed condition.

As the cigarettes are removed (FIGS. 5–7), collapse is facilitated by score line 48 and 50 in the side panels and score line 52 in the bottom panel which forms zones of weakness so that the walls of the package can uniformly collapse when the contents thereof are reduced. As the package collapses and the depth is reduced, the tabs 58 and 60 are forced toward one another (FIG. 9) by the combined movement of the bottom panel bending outward and the front and rear panels moving together. In this manner, the tabs are shifted angularly until the beveled surface of each tab comes in contact with the respective front or rear panel it is most distal from (FIG. 10). To accomplish the relative movement between the tabs, the freedom of movement between the tabs permits them to slide across one another into engagement with the opposing rear or front panel.

Figure 8:
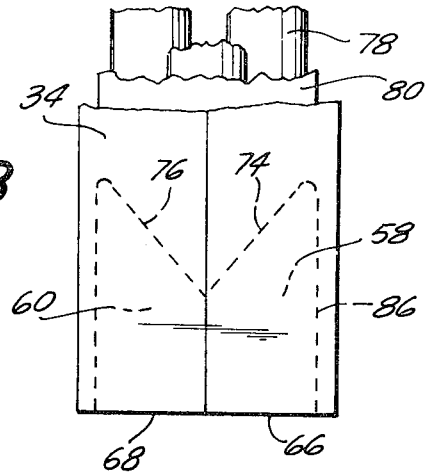
FIG. 8 is a fragmentary side elevation view of the package of the invention.

Thus, in operation, tab 58 in the initial uncollapsed position (FIG. 8) is captured in position by engagement between edge 86 and back panel 24, the score line 66 with the bottom panel and engagement between its outer surface and the adjacent side panel. As the package collapses, score line 66 is angularly displaced and back panel 24 moves toward front panel 22, and tab 58 is shifted until beveled surface 74 engages with front panel 22. At that point, further collapse is restricted and support is provided to alleviate the danger of damage to the remaining contents of the package with the package in the partially collapsed position. The same action occurs with respect to the remaining tabs. Movement of panels 22 and 24 toward one another is also accommodated by the outward collapse of the side panels about longitudinal score lines 48 and 50 so that a uniform collapse of the entire package is produced about the three score lines 52, 50 and 48. As stated above, as the tabs shift angularly, they slide across one another into engagement with the appropriate back or front panel. There is sufficient clearance provided to alleviate the danger of jamming of the tabs against one another or a deleterious effect of the tabs on the other portions of the package including the inner foil and cigarettes in the shifting movement.

Thus, a partially collapsible hard pack is provided with the cigarettes contained therein being provided with protection even when a number of them are removed. The collapsing of the package makes it more usable for the consumer's pocket.

The entire package is formed out of one paperboard blank or a conventional substitute material therefor with score lines or creases being provided in the side panels and the bottom panel to facilitate the collapse. The tabs have a predetermined configuration and size to that a predetermined amount of collapse can be provided for. One acceptable percentage of collapse is one in which the depth of the package is permitted to be reduced until it is about 60 percent of its original depth.

It should be noted that the tabs are positioned and configured so that they will not jam against and possibly damage the inner wrapper or foil and the cigarettes. This is particularly of importance when dealing with a fragile laminated foil-paper material and a vulnerable open end of a tobacco cigarette.

The package is permitted to collapse to the desired degree with product usage without any product damage and with the package collapsing symmetrically to a predetermined thickness. There is no distortion, destruction or deleterious effect on any parts of the package during the collapsing action. It is accomplished quickly and efficiently. The one piece blank with appropriate creases and score lines can be inexpensively manufactured and can be quickly and efficiently and, accordingly, inexpensively formed into the ultimate package for the cigarette.

Thus, the several aforenoted objects and advantages are most effectively attained. Although several somewhat preferred embodiments have been disclosed and described in detail herein it should be understood that this invention is in no sense limited thereby, and its scope is to be determined by that of the appended claims.

I claim:

1. A partially collapsible package comprising; a pair of opposing rigid front and rear panels, a bottom panel hinged on opposite edges to the front and rear panels and a pair of side panels hinged to the front and rear panels to form a package closed at the bottom and open at the top to receive and remove articles therethrough, each side panel and bottom panel having a weakened zone to permit collapse of the package in the direction bringing the front and rear panels together, and stop means on the panels and positioned so that as the package is collapsed the stop means will permit limited movement and partial collapse of the package and then will support the package and resist further collapse thereby providing for a partially collapsible supporting package to protect articles contained therein when the package is full and while articles are being removed and the package collapses accordingly.

2. A partially collapsible package comprising; a pair of opposing rigid front and rear panels, a bottom panel hinged on opposite edges to the front and rear panels, and a pair of side panels hinged to the front and rear panels to form a package closed at the bottom and open at the top to receive and remove articles therethrough, each side panel and bottom panel having a weakened zone to permit collapse of the package in the direction bringing the front and rear panels together, and an arrangement of tabs hinged to the panels and positioned so that as the package is collapsed the tabs will be free for limited movement to permit partial collapse of the package and then to support the package and resist further collapse by engagement between the moved tabs and surfaces of the package thereby providing for a partially collapsible supporting package to protect articles contained therein when the package is full and while articles are being removed and the package collapses accordingly.

3. The invention in accordance with claim 2 wherein the package contains smoking articles.

4. The invention in accordance with claim 2 wherein the smoking articles are cigarettes.

5. The invention in accordance with claim 2 wherein the package is formed of paperboard.

6. The invention in accordance with claim 2 wherein each tab extends from an edge of the bottom panel adjacent to an edge hinged to one of the front and rear panels.

7. The invention in accordance with claim 6 wherein there are two tabs extending from each of the pair of opposing edges of the bottom panel adjacent to edges hinged to the front and rear panels, the tabs being hinged to the bottom panel to be directed into alignment with the side panels and front and rear panel when the package is formed.

8. The invention in accordance with claim 7 wherein each tab has a beveled surface on the edge distal from the hinged connection with the bottom panel, the beveled edge of each tab facing the beveled edge of an adjacent tab, the tabs having freedom of movement angularly with respect to the bottom panel so as to cross one over the other until the beveled edge of each tab comes into contact with the inner surface of a front or back panel thereby forming an interengagement therebetween to restrict further collapsing of the package and to provide support to protect the articles contained therein.

9. The invention in accordance with claim 2 wherein the weakened zones in the side panels and bottom panel are formed by a score line intermediate the longitudinal edges of each panel.

10. The invention in accordance with claim 1 wherein the hinged connections between the panels are formed by score lines along the adjoining edges thereof.

11. The invention in accordance with claim 10 wherein the side panel hinged to one of the front and rear panels is formed by a pair of opposing projections from the longitudinal edges of one of the front and rear panels with each projection hinged to the one panel by a score line formed at the adjoining edges therebetween, the other of the front and rear panels having a pair of opposed larger projections extending from the longitudinal edges thereof and the larger projections being hinged to the other panel by means of a score line formed therebetween to permit the larger projections to be positioned to form the side panels when the package is formed, each larger projection having a score line intermediate its longitudinal edges to form two parts thereon with one part being positioned for alignment and attachment to a projection from the other panel to form the package, the score line in the larger projections cooperating with a similar score line in the bottom panel to form the weakened zone to permit partial collapse of the package.

12. The invention in accordance with claim 2 wherein the package is free to collapse to approximately 60 percent of original depth and is restricted from further collapse by the presence of the tabs.

13. The invention in accordance with claim 2 wherein the articles are cigarettes and an inner flexible foil-paper protective wrapper is positioned between the cigarettes and the adjacent surfaces of the package to provide additional protection for the cigarettes without detracting from the partial collapsing action of the package.

14. The invention in accordance with claim 13 wherein an outer wrapper is applied to the exposed surfaces of the package and is flexible to accommodate the partial collapsing of the package.

15. A blank for forming a partially collapsible package comprising; a sheet of rigid material having a configuration to form a pair of opposing rigid front and rear panels, a bottom panel hinged on opposite edges to the front and rear panels, and a pair of side panels hinged to the front and rear panels to permit the blank to be reoriented from a flat configuration into a packaged configuration closed at the bottom and open at the top to receive and remove articles therethrough, each side panel having a weakened zone to permit collapse of the blank when formed into the package configuration in the direction bringing the front and rear panels together, and stop means on the blank and positioned so that as the package formed by the blank is collapsed the stop means will permit partial collapse of the package and then will support the package and resist further collapse thereby providing a blank for forming a partial collapsible supporting package to protect articles contained therein when the package is full and while articles are being removed and the package collapses accordingly.

16. A blank for forming a partially collapsible package comprising; a sheet of rigid material having a configuration to form a pair of opposing rigid front and rear panels, a bottom panel hinged on opposite edges to the front and rear panels, and a pair of side panels hinged to the front and rear panels to permit the blank to be reoriented from a flat configuration into a package configuration closed at the bottom and open at the top to receive and removing articles therethrough, each side panel having a weakened zone to permit collapse of the blank when formed into the package configuration in the direction bringing the front and rear panel together, and an arrangement of tabs on the blank hinged to the panels and positioned so that as the package formed by the blank is collapsed the tabs will be free for limited movement to permit partial collapse of the package and then to support the package and resist further collapse by engagement between the moved tabs and surfaces of the package thereby providing a blank for forming a partially collapsible supporting package to protect articles contained therein when the package is full and while articles are being removed and the package collapses accordingly.

17. The invention in accordance with claim 16 wherein the package contains smoking articles.

18. The invention in accordance with claim 17 wherein the smoking articles are cigarettes.

19. The invention in accordance with claim 16 wherein the blank is formed of paperboard material.

20. The invention in accordance with claim 16 wherein each tab extends from an edge of the bottom panel adjacent to an edge hinged to one of the front and rear panels.

21. The invention in accordance with claim 16 wherein there are two tabs extending from each of the pair of opposing edges of the bottom panel adjacent to the edges hinged to the front and rear panels, and tabs being hinged to the bottom panel to be directed into alignment with the side panels and front and rear panel when the package is formed.

22. The invention in accordance with claim 21 wherein each tab has a beveled surface on the edge distal from the hinged connection with the bottom panel, the beveled edge of each tab facing the beveled edge of an adjacent tab, the tabs having freedom of movement angularly with respect to the bottom panel so as to cross one over the other until the beveled edge of each tab comes into contact with the inner surface of a front or back panel thereby forming an interengagement therebetween to restrict further collapsing of the package and to provide support to protect the articles contained therein.

23. The invention in accordance with claim 16 wherein the weakened zones in the side panels and bottom panel are formed by a score line intermediate the longitudinal edges of each panel.

24. The invention in accordance with claim 16 wherein the hinged connections between the panels are formed by score lines along the adjoining edges thereof.

25. The invention in accordance with claim 24 wherein the side panel hinged to one of the front and rear panels is formed by a pair of opposing projections from the longitudinal edges of one of the front and rear panels with each projection hinged to the panel by a score line formed at the adjoining edges therebetween, the other of the front and rear panels having a pair of opposed larger projections extending from the longitudinal edges thereof and the larger projections being hinged to the other panel by means of a score line formed therebetween to permit the larger projections to be positioned to form the side panels when the package is formed, each larger projection having a score line intermediate its longitudinal edges to form two parts thereon with one part being positioned for alignment and attached to a projection from the other panel to form the package, the score line in the larger projections cooperating with a similar score line in the bottom panel to form the weakened zone to permit partial collapse of the package.

* * * * *